US006564876B2

(12) United States Patent
Vaynshteyn et al.

(10) Patent No.: US 6,564,876 B2
(45) Date of Patent: May 20, 2003

(54) PACKER

(75) Inventors: Vladimir Vaynshteyn, Sugar Land, TX (US); James D. Hendrickson, Sugar Land, TX (US); Jim B. Benton, Friendswood, TX (US); Raghu Madhaven, Brookfield, CT (US); Mitchell G. Willcox, Houston, TX (US); Dinesh R. Patel, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/745,973

(22) Filed: Feb. 9, 2001

(65) Prior Publication Data

US 2001/0002621 A1 Jun. 7, 2001

Related U.S. Application Data

(62) Division of application No. 09/295,915, filed on Apr. 21, 1999, now Pat. No. 6,186,227.

(51) Int. Cl.[7] ..... E21B 23/04; E21B 23/06; E21B 33/126; E21B 33/1295

(52) U.S. Cl. ..... 166/387; 166/51; 166/120; 166/123; 166/188; 166/317

(58) Field of Search ..... 166/55.1, 120, 166/123, 124, 125, 138, 139, 181, 188, 297, 317, 376, 386, 387

(56) References Cited

U.S. PATENT DOCUMENTS

| | | | | | |
|---|---|---|---|---|---|
| 4,018,274 | A | * | 4/1977 | Cochran | 166/138 X |
| 4,040,485 | A | * | 8/1977 | Vann et al. | 166/297 |
| 4,307,781 | A | * | 12/1981 | Preston, Jr. et al. | 166/123 |
| 5,197,547 | A | * | 3/1993 | Morgan | 166/387 |
| 5,320,176 | A | * | 6/1994 | Naquin et al. | 166/386 |
| 5,320,183 | A | * | 6/1994 | Muller et al. | 166/387 |
| 5,348,092 | A | * | 9/1994 | Cornette et al. | 166/227 |

* cited by examiner

*Primary Examiner*—George Suchfield
(74) *Attorney, Agent, or Firm*—Trop, Pruner & Hu, P.C.; Jeffrey Griffin; Brigitte Jeffery

(57) ABSTRACT

A packer for use inside a casing of a subterranean well includes a resilient element, a housing and a rupture disc. The resilient element is adapted to seal off an annulus of the well when compressed, and the housing is adapted to compress the resilient element in response to a pressure exerted by fluid of the annulus of a piston head of the housing. The housing includes a port for establishing fluid communication with the annulus. The rupture disc is adapted to prevent the fluid in the annulus from entering the port and contacting the piston head until the pressure exerted by the fluid exceeds a predefined threshold and ruptures the rupture disc.

29 Claims, 7 Drawing Sheets

PACKER

This is a divisional of prior application Ser. No. 09/295,915, filed on Apr. 21, 1999 now U.S. Pat. No. 6,186,227.

BACKGROUND

The invention relates to a packer.

As shown in FIG. 1, for purposes of measuring characteristics (e.g., formation pressure) of a subterranean formation 31, a tubular test string 10 may be inserted into a wellbore that extends into the formation 31. In order to test a particular region, or zone 33, of the formation 31, the test string 10 may include a perforating gun 30 that is used to penetrate a well casing 12 and form fractures 29 in the formation 31. To seal off the zone 33 from the surface of the well, the test string 10 may be attached to, for example, a retrievable weight set packer 27 that has an annular elastomer ring 26 to form a seal (when compressed) between the exterior of the test string 10 and the internal surface of the well casing 12, i.e., the packer 27 seals off an annular region called an annulus 16 of the well. Above the packer 27, a recorder 11 of the test string 10 may take measurements of the test zone pressure.

The test string 10 typically includes valves to control the flow of fluid into and out of a central passageway of the test string 10. For example, an in-line ball valve 22 may control the flow of well fluid from the test zone 33 up through the central passageway of the test string 10. As another example, above the packer 27, a circulation valve 20 may control fluid communication between the annulus 16 and the central passageway of the test string 10.

The ball valve 22 and the circulation valve 20 may be controlled by commands (e.g., "open valve" or "close valve") that are sent downhole from the surface of the well. As an example, each command may be encoded into a predetermined signature of pressure pulses 34 see (FIG. 2) that are transmitted downhole via hydrostatic fluid that is present in the annulus 16. A sensor 25 may receive the pressure pulses 34 so that the command may be extracted by electronics of the string 10. Afterwards, electronics and hydraulics of the test string 10 operate the valves 20 and 22 to execute the command.

Two general types of packers typically may be used: the retrievable weight set packer 27 that is depicted in FIG. 1 and a permanent hydraulically set packer 60 that is depicted in FIG. 3. To set the weight set packer 27 (i.e., to compress the elastomer ring 26 to force the ring 26 radially outward), an upward force and/or a rotational force may be applied to the string 10 to actuate a mechanism (of the string 10) to release the weight of the string 10 upon the ring 26. However, rotational and translational manipulations of the test string 10 to set the packer 27 may present difficulties for a highly deviated wellbore and for a subsea well in which a vessel is drifting up and down, a movement that introduces additional motion to the test string 10. Additional drill collars 44 (one drill collar 44 being shown in FIG. 1) may be required to compress the ring 26. Slip joints 46 may be needed to compensate for expansion and contraction of the string 10.

Referring to FIG. 3, the hydraulically set packer 60 may be set by a setting tool that is run downhole on a wireline, or alternatively, the hydraulically set packer 60 may be run downhole on a tubing and set by establishing a predetermined pressure differential between the central passageway of the tubing and the annulus 16. Among the differences from the weight set packer 27, the packer 60 typically remains permanently in the wellbore after being set, a factor that may affect the number of features that are included with the packer 60. Furthermore, a separate downhole trip typically is required to set the packer 60. For example, a special tool maybe run downhole with the packer 60 to set the packer 60 in one downhole trip, and afterwards, another downhole trip may be required to run the test string 10. Because the test string 10 must pass through the inner diameter of a seal bore 62 of the packer 60, the outer diameter of the perforating gun 54 maybe limited, and stinger seals 52 of the test string 10 maybe damaged.

Thus, there exists a continuing need for a packer that addresses one or more of the above-stated problems.

SUMMARY

In one embodiment of the invention, a packer for use inside a casing of a subterranean well includes a resilient element, a housing and a rupture disk. The resilient element is adapted to seal off an annulus of the well when compressed, and the housing is adapted to compress the resilient element in response to a pressure exerted by fluid of the annulus on a piston head of the housing. The housing includes a port for establishing fluid communication with the annulus. The rupture disk is adapted to prevent the fluid in the annulus from entering the port and contacting the piston head until the pressure exerted by the fluid exceeds a predefined threshold and ruptures the rupture disk.

In another embodiment, a method for setting a packer in a subterranean well includes isolating a resilient element from pressure being exerted from a fluid in an annulus of the well until the resilient element is at a predefined depth in the well. When the resilient element is at the predefined depth, the fluid in the annulus is allowed to compress the resilient element to seal off the annulus.

Advantages and other features of the invention will become apparent from the following description and from the claims.

DETAILED DESCRIPTION

Figure 1:
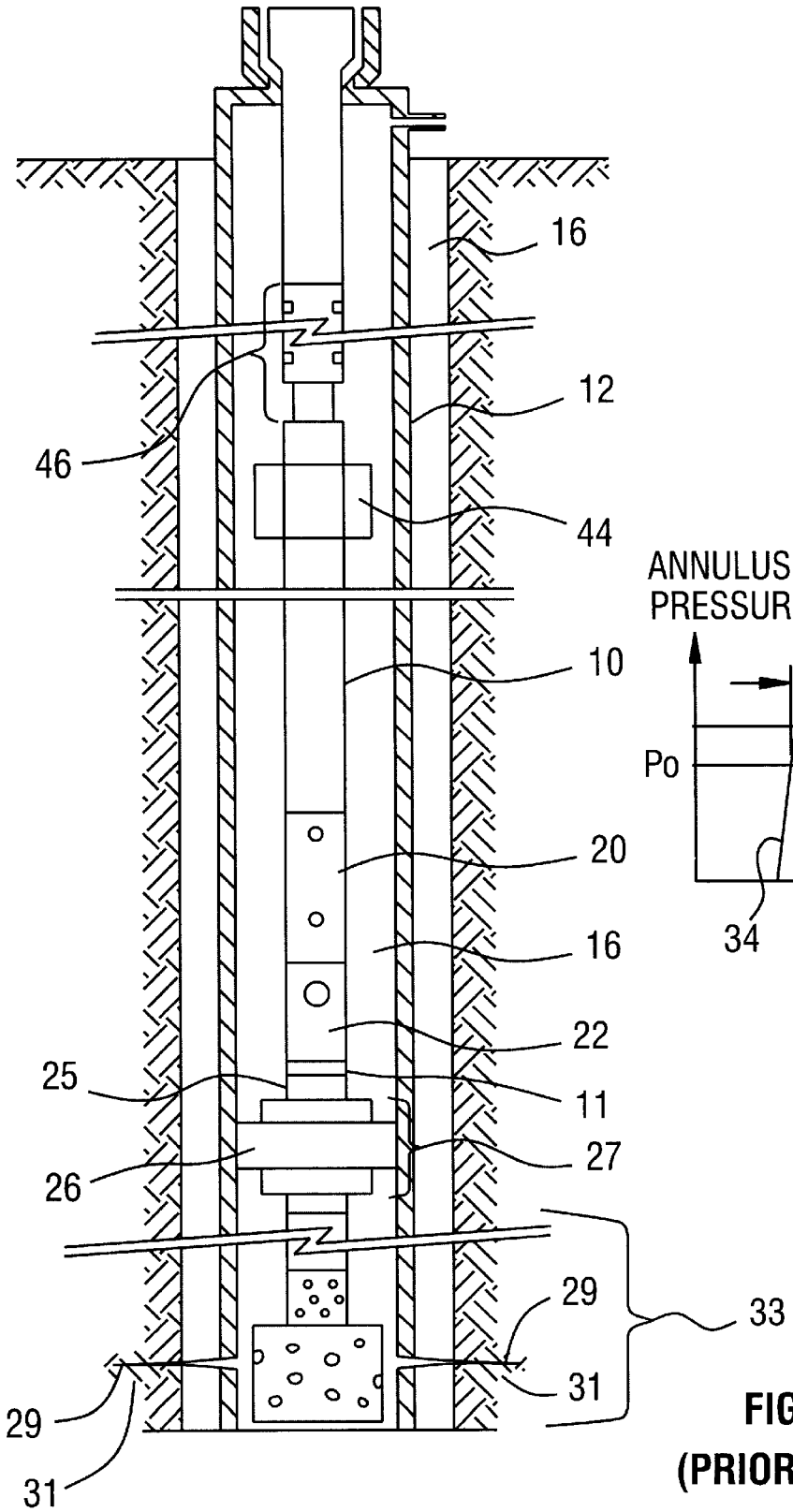
FIG. 1 (PRIOR ART)
FIGS. 1 and 3 are schematic views of test strings of the prior art in wells being tested.
Figure 2:
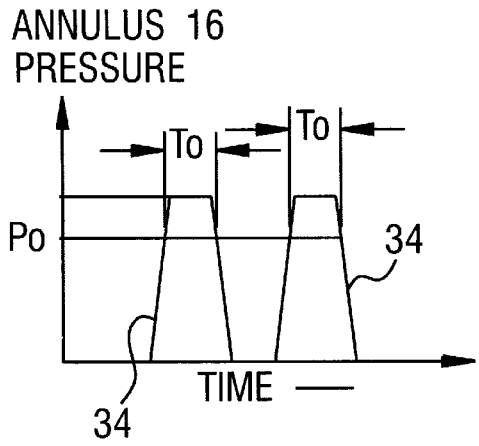
FIG. 2 (PRIOR ART)
FIG. 2 is a waveform illustrating a pressure pulse command for a tool of the test strings of FIGS. 1 and 3.
Figure 3:
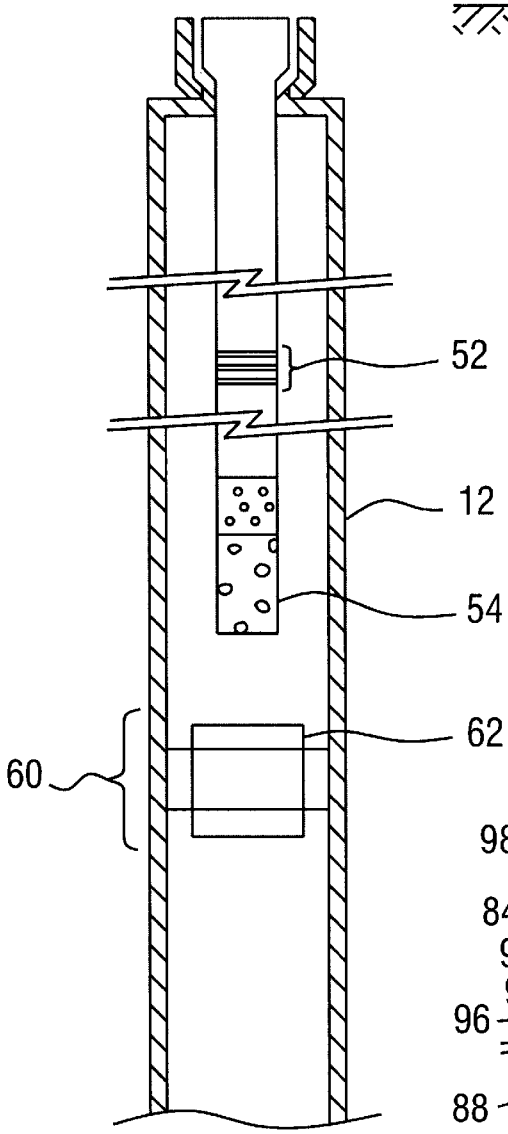
FIG. 3 (PRIOR ART)
Figure 4:
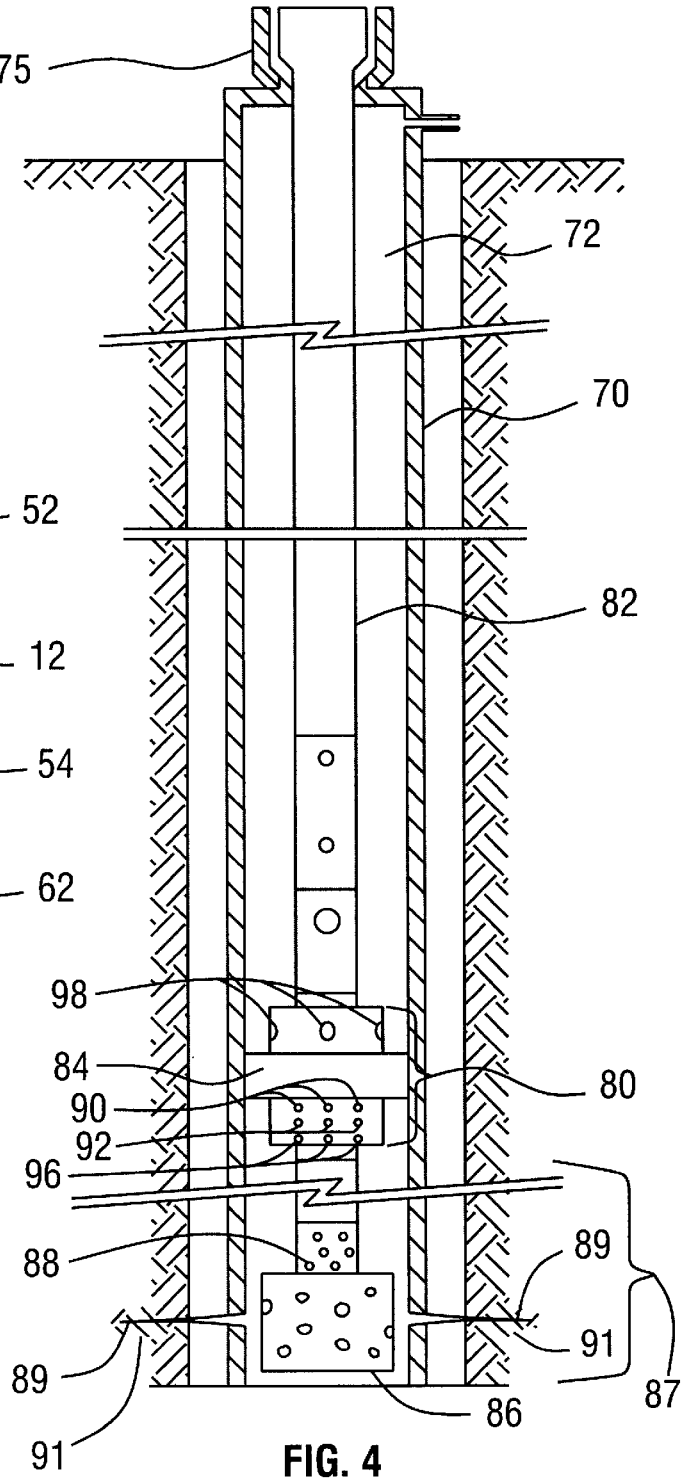
FIG. 4 is a schematic view of a test string in a well being tested according to an embodiment of the invention.
Figure 10:
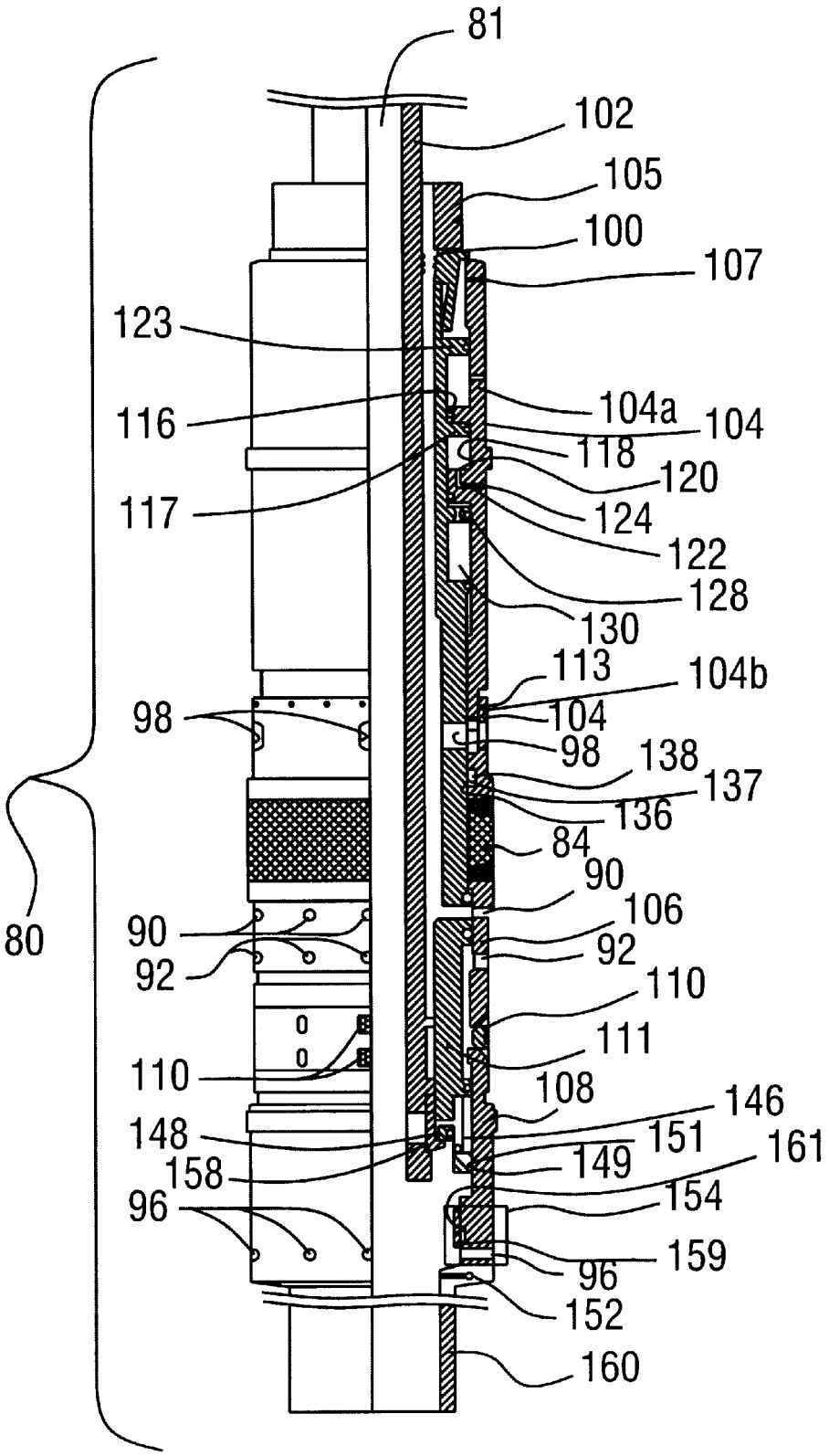

Referring to FIG. 4, an embodiment 80 of a hydraulically set, retrievable packer 80 in accordance with the invention may be run downhole with a tubing, or test string 82, and set (to form a test zone 87) by applying pressure to an annulus 72. More particularly, in some embodiments, construction of the packer 80 permits the packer 80 to be placed in three different configurations: a run-in-hole configuration (FIG. 5), a set configuration (FIG. 7), and a pull-out-of-hole configuration (FIG. 10). The packer 80 is placed in the run-in-hole configuration before being lowered into the wellbore with the string 82. Once the packer 80 is in position in the wellbore, pressure is transmitted through hydrostatic fluid present in the annulus 72 to place the packer 80 in the set configuration in which the packer 80 secures itself to a well casing 70, seals off the test zone 87, permits the string 82 to move through the packer 80, and maintains a seal between the interior of the packer 80 and the exterior of the string 82. After testing is complete, an upward force may be applied to the string 82 to place the packer 80 in the pull-out-of-hole configuration to disengage the packer 80 from the casing 70.

As described further below, due to the design of the packer 80, the string 82 (secured by a tubing hanger 75, for example, for offshore wells) is allowed to linearly expand and contract without requiring slip joints. Because the string 82 is run downhole with the packer 80, seals (described below) between the string 82 and the packer 80 remain protected as the packer 80 is lowered into or retrieved from the wellbore, and the perforating gun 86 may have an outer diameter larger than a seal bore (described below) of the packer 80.

Thus, the advantages of the above-described packer may include one or more of the following: the packer may be retrieved upon completion of testing; drill collars may not be required to set the packer; slip joints may not be required; movement or manipulation of the test string may not be required to set the packer; performance in deviated and deep sea wells may be enhanced; downhole gauges may remain stationary during well testing; subsea tree and guns may be positioned before setting the packer; the packer may be compatible with large size guns for better perforating performance; and a bypass valve (described below) of the packer may improve well killing capabilities of the test string.

To form a seal between an outer housing of the packer 80 and the interior of the casing 70 (in the set configuration of the packer 80), the packer 80 has an annular, resilient elastomer ring 84. In this manner, once in position downhole, the packer 80 is constructed to convert pressure exerted by fluid in the annulus 72 of the well into a force to compress the ring 84. This pressure may be a combination of the hydrostatic pressure of the column of fluid in the annulus 72 as well as pressure that is applied from the surface of the well. When compressed, the ring 84 expands radially outward and forms a seal with the interior of the casing 70. The packer 80 is constructed to hold the ring 84 in this compressed state until the packer 80 is placed in the pull-out-of-hole configuration, a configuration in which the packer 80 releases the compressive forces on the ring 84 and allows the ring 84 to return to a relaxed position, as further described below.

Because the outer diameter of the ring 84 (when the ring 84 is in the uncompressed state) is closely matched to the inner diameter of the casing 70, there may be only a small annular clearance between the ring 84 and the casing 70 as the packer 84 is being retrieved from or lowered into the wellbore. To circumvent the forces present as a result of this small annular clearance, the packer 80 is constructed to allow fluid to flow through the packer 80 when the packer 80 is beginning lowered into or retrieved from the wellbore. To accomplish this, the packer 80 has radial bypass ports 98 that are located above the ring 84. In the run-in-hole configuration, the packer 80 is constructed to establish fluid communication between radial bypass ports 92 located below the ring 84 and the radial ports 98, and in the pull-out-of-hole configuration, the packer 80 is constructed to establish fluid communication between other radial ports 90 located below the ring 84 and the radial ports 98. The radial ports 98 above the ring 84 are always open. However, when the packer 80 is set, the radial ports 90 and 92 are closed.

The packer 80 also has radial ports 96 that are used to inject a kill fluid to "kill" the producing formation. The ports 96 are located below the ring 84 in a lower housing 108 (described below), and each port 96 is part of a bypass valve 154. The bypass valve 154 remains closed until the pressure exerted by fluid in the lower annulus 71 exceeds a predetermined pressure level to rupture a rupture disc 157 of the bypass valve 154. Once this occurs, fluid in the annulus enters the port 96 to exert pressure upon a lower surface of a piston head 161 of a mandrel 159 that is coaxial with the packer 80. Before the rupture disc 157 ruptures, the mandrel 159 blocks the port 96. However, after the rupture disc 157 ruptures, the pressure exerted by the fluid on the lower surface of the piston head 161 is greater than the pressure exerted by gas of an atmospheric chamber 155 on the upper surface of the piston head 161. As a result, the mandrel 159 moves in an upward direction to open the port 96.

Because the ports 98 are always open, the opening of the ports 96 establishes fluid communication between the lower 71 annulus and the upper annulus 72. Once this occurs, a formation kill fluid is injected into the annulus 72. The kill fluid flows out of the ports 98, mixes with gases and other well fluids present in the annulus 71, enters a perforated tailpipe 88 (located near the gun 86) of the string 80 and flows up through a central passageway of the string 10.

Figure 5:
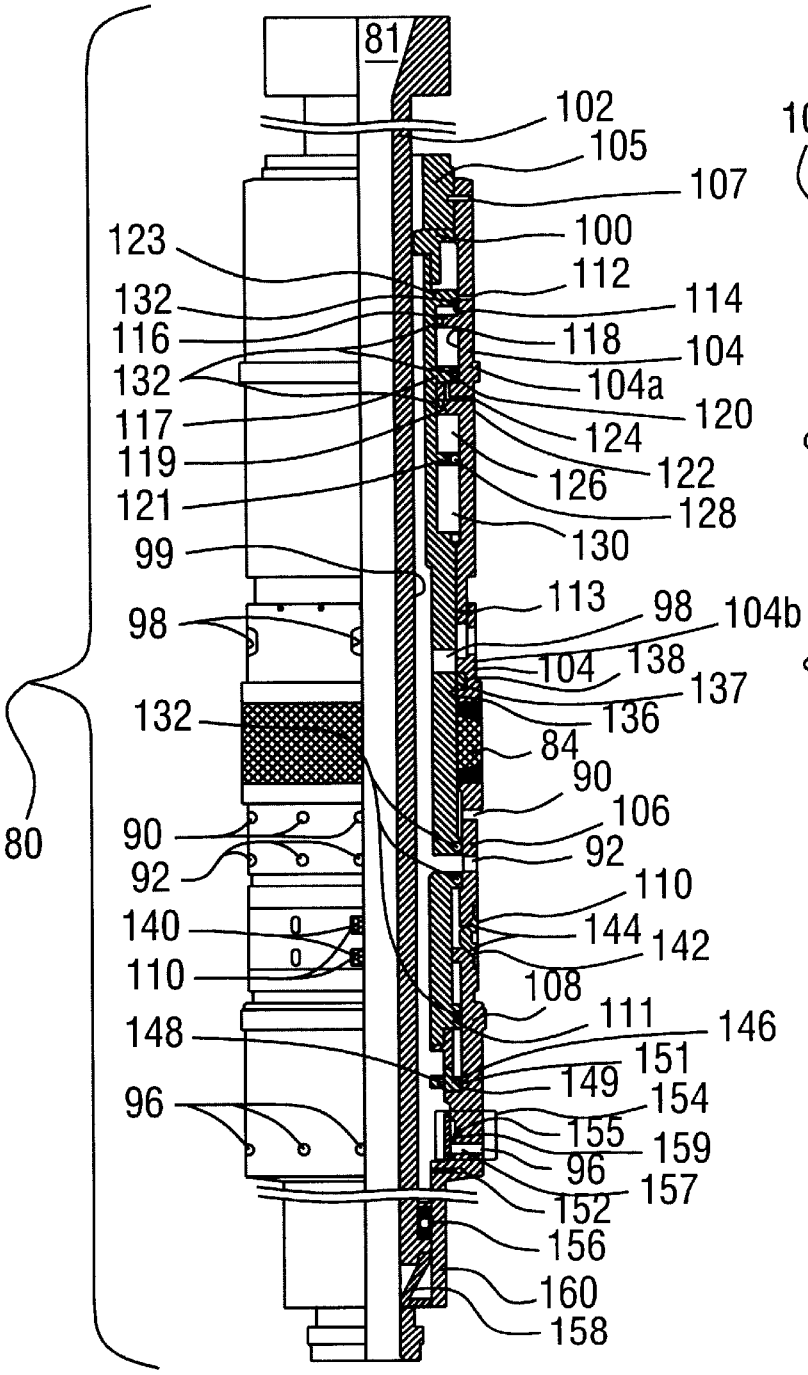
FIGS. 5, 7, and 10 are schematic views of a packer of the test string of FIG. 4 according to an embodiment of the invention.

Referring to FIG. 5, when the packer 80 is placed in the run-in-hole configuration, the ring 84 is in a relaxed, uncompressed position. At its core, the packer 80 has a stinger tubing 102 that is coaxial with and shares a central passageway 81 with the string 82. The tubing 102 forms a section of the string 82 and has threaded ends to connect the packer 80 into the string 82. The tubing 102 is circumscribed by the ring 84, an upper housing 104, a middle housing 106 and a lower housing 108. When sufficient pressure is applied to the annulus 72, the housings 104, 106, and 108 are constructed to compress the ring 84 (as described below), and subsequently, when the string 82 is pulled a predetermined distance upward to exert a predetermined longitudinal force on the tubing 102, the housings 104, 106, and 108 are constructed to release the ring 84 (as described below). In some embodiments, the three housings 104, 106, and 108 and the uncompressed ring 84 have approximately the same diameter. The ring 84 is located between the upper housing 104 and the middle housing 106, with the lower housing 108 supporting the middle housing 106.

Figure 7:
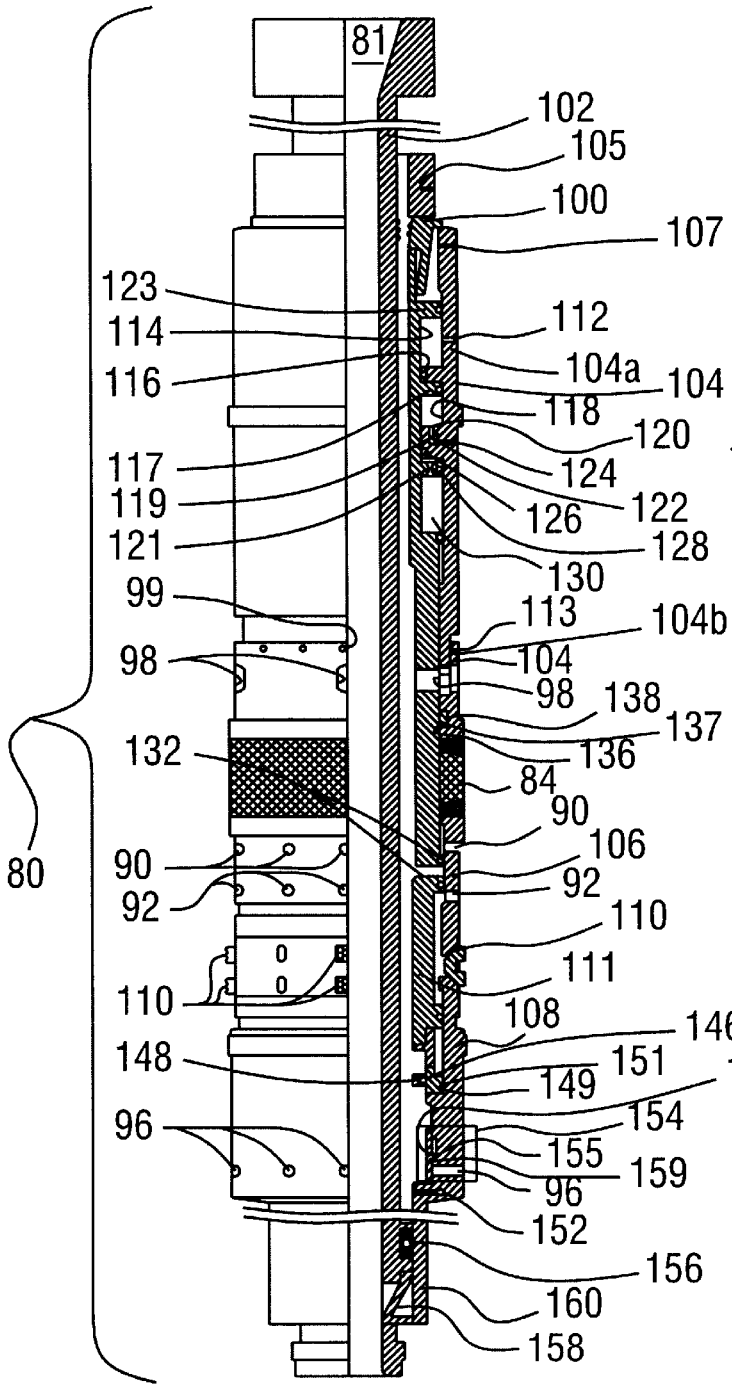

To hold the housings 104, 106, and 108 together, the packer 80 has an inner stinger sleeve, or housing 105, that circumscribes the tubing 102 and is radially located inside the housings 104, 106, and 108. The housing 105, along with the radial ports 90, 92 and 98, effectively forms a bypass valve. In this manner, as depicted in FIG. 5, the housing 105 has radial ports that align with the ports 92 when the packer 80 is placed in the run-in-hole configuration to allow fluid communication between the ports 92 and 98. The housing 105 blocks fluid communication between the ports 90 and 92 and the ports 98 when the packer 80 is placed in the set configuration (as depicted in FIG. 7), and the housing 105 permits communication between the ports 90 and 98 when the packer 82 is placed in the pull out of hole configuration (as depicted in FIG. 10).

Figure 8:
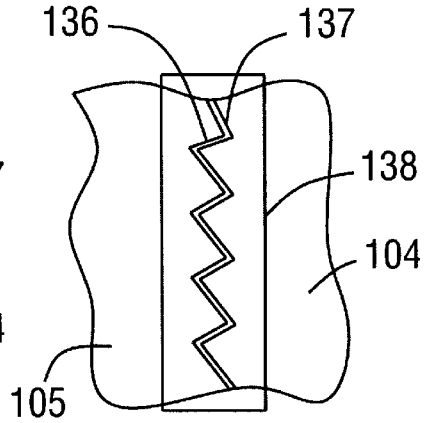
FIG. 8 is a detailed view of a ratchet of the packer of FIG. 4.

Referring also to FIG. 8, the bottom housing 108 is releasably attached to the housing 105, and the top housing 104 is attached to the housing 105 via a ratchet mechanism 138 that is secured to the housing 106. As the top 104 and bottom 108 housings move closer together to compress the ring 84, teeth 137 of the housing 104 crawl down teeth 136 that are formed in the housing 105. As a result of this arrangement, the compressive forces on the ring 84 are maintained until the packer is placed in the pull-out-of-hole configuration, as described below.

Still referring to FIG. 5, more particularly, the compressive forces that are exerted by the housings 104, 106, and 108 on the ring 84 are released when the attachment between the lower housing 108 and the housing 105 is released, as described below. As a result of this release, the bottom housing 108 and the middle housing 106 (supported by the bottom housing 108) fall away from the ring 84.

In the run-in-hole configuration, the radial ports 92 are aligned with ports that extend through the housing 105. The ports in the housing open into an annular region 99 (between the housing 105 and the tubing 102) which is in communication with the radial ports 98. The ports 98 are formed from openings in the middle housing 106 and the housing 105.

Figure 6:
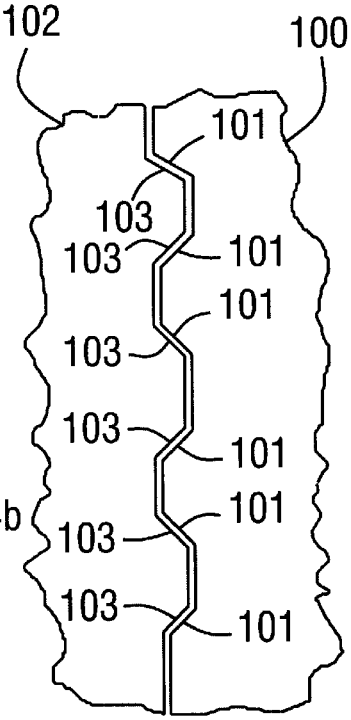
FIG. 6 is a detailed view of a connection between a tubing and a fastener of the packer of FIG. 4.

To prevent the housing 105 (and housings 104, 106, and 108) from sliding down the tubing 102 when the packer 80 is in the run-in-hole configuration, the housing 105 has openings that hold one or more clamps 100 that secure the housing 105 to the tubing 102. As shown in FIG. 6, the clamps 100 having inclined teeth 101 that are adapted to mate with inclined teeth 103 that are formed on the tubing 102. The interaction between the faces of the teeth 101 and 103 produce upward and radially outward forces on the clamps 100. Although the upward forces keep the housing 105 from sliding down the tubing 102, the radial forces tend to push the clamps 100 away from the tubing 102. However, in the run-in-hole configuration, the upper housing 104 is configured to block radial movement of the clamps 100 and keep the clamps 100 pressed against the teeth 101 of the tubing 102.

Referring to FIG. 7, once the packer 80 is in position to be set, the packer 80 is placed in the set configuration by applying pressure to the hydrostatic fluid in the annulus 72. When the pressure in the annulus 72 exceeds a predetermined level, the fluid pierces a rupture disc 124 that is located in a radial port 122 of the housing 104. When the disc 124 is pierced, the port 122 establishes fluid communication between the annulus 72 and an upper face 120 of an annular piston head 119 of the upper housing 104. The piston 119 is located below a mating annular piston head 117 of the housing 105. An annular atmosphere chamber 118 is formed above the extension 119. Thus, when fluid communication is established between the annulus 72 and the piston head 119, the pressure on the fluid creates a downward force on the piston head 119 (and on the upper housing 104), and when a shear pin 107 (securing the upper housing 104 and the housing 105 together) shears, the upper housing 104 begins moving downward and begins compressing the ring 84.

To ensure that the ring 84 is slowly compressed, the packer 80 has a built-in damper to control the downward speed of the upper housing 104. The damper is formed from an annular piston head 121 of the housing 105 that extends between the housing 105 and the upper housing 104. The piston head 121 forms an annular space 126 between the upper face of the piston head 121 and the lower face of the piston 119. This annular space 126 contains hydraulic fluid which is forced through a flow restrictor 128 when the lower face of the piston 119 exerts force on the fluid, i.e., when the upper housing 104 moves down. The flow restrictor 128 is formed in the piston head 121 and opens into an annular chamber 130 formed below the piston head 121 for receiving the hydraulic fluid.

Because the surface area of the upper face of the piston head 119 is limited by the interior diameter of the casing 70, in some embodiments, the upper housing 104 may have another annular piston head 116 to effectively multiply (e.g., double) the force exerted by the upper housing 104 on the ring 84. Although another radial port 112 in the upper housing 104 is used to establish fluid communication between the annulus 72 and an upper face of the piston head 116, in some embodiments, another rupture disc is not used. Instead, an annular extension 123 of the housing 105 is used to initially block the port 112 before the shear pin 107 breaks and the upper housing 104 begins to move. Once the port 112 moves past the extension 123, fluid from the annulus 72 enters an annular region 114 between the lower face of the extension 123 and the upper face of the piston head 116, and thereafter, a downward force is exerted by the piston head 116 until the packer 84 is set.

To establish a desired level of compression force on the ring 84 (i.e., to establish a force limit on the resilient element 84), the upper housing 104 may be formed from an upper piece 104*a* and a lower piece 104*b*. Radially spaced shear pins 113 hold the upper 104*a* and lower 104*b* pieces together until the desired level of compression is reached and the shear pins 113 shear. Upon this occurrence, the two pieces 104*a* and 104*b* are separated and additional compression on the ring 84 is prevented.

When in the set configuration, the packer 80 is constructed to push slips 110 radially outwardly to secure the packer 80 to the casing 70. The slips 110 are located between the middle 106 and lower 108 housings. The housings 106 and 108 have upper 140 and lower 144 inclined faces that are adapted to mate with inclined faces 142 of the slips 110 and push the slips 110 toward the casing 70 when the housing 104 pushes the middle housing 106 toward the lower housing 108.

Once the packer 80 is set, the string 82 moves freely through the packer 84. To accomplish this, the upper housing 104 is configured to slide past the clamps 100 when the housing 104 compresses the ring 84. As a result, there are no radially inward forces exerted against the clamps 100 to hold the clamps 100 against the tubing 102. Thus, the clamps 100 release their grip on the tubing 102, and as a result, the tubing 102 is free to move with respect to the rest of the packer 80.

Figure 9:
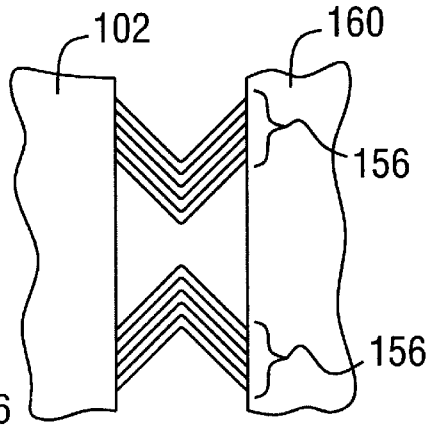
FIG. 9 is a detailed view of stinger seals.

A cylindrical seal bore 160, is constructed in the housing 105. The seal bore 160 provides a smooth interior surface for establishing a seal with annular seals 156 (see also FIG. 9) that circumscribe the tubing 102. The seals 156 remain in the seal bore 160 at all times, i.e., as the packer 80 is run downhole, when the packer 80 is set, and when the packer 80 is retrieved uphole. Thus, the seal bore 160 protects the seals 156 at all times. The seal bore 160 has a length (e.g., twenty feet) that is sufficient to permit thermal expansion and contraction of the string 82.

As shown in FIG. 10, the packer 80 is placed in the pull-out-of-hole configuration by disconnecting the lower housing 108 from the housing 105, an action that allows the lower housing 108 to slide down and rest on an annular extension 111 of the housing 105). As a result of this disconnection, the radially outward forces exerted against the slips 110 (by the middle 106 and lower 108 housings) are relaxed to disengage the slips 110, and the compression forces placed against the ring 84 are removed. To accomplish this, the lower housing 108 is connected to the housing 105 by a clamp 146 of the housing 105 that has teeth 151 (similar to the teeth 101 of the stinger 100) that are adapted to mate with teeth 149 (similar to the teeth 103) of the lower housing 108. The teeth 149 push radially inwardly on the teeth 151 and tend to force the housing 105 away from the lower housing 108. However, a ring 148 that circumscribes the tubing 102 is attached (via screws) to an interior surface of the clamp 146. The ring 148 counters the radially inward forces to hold the teeth 149 and 151 (and the housing 105 and lower housing 108) together.

To release the connection between the housing 105 and the lower housing 108, the tubing 102 has a collet 158 that is attached near the bottom of the tubing 102. The collet 158 is configured to grab the ring 148 as the end of the tubing 102 passes near the ring 148. When a predetermined force is applied upwardly on the tubing 102, the screws that hold the ring 148 to the housing 105 are sheared, and as a result, the collet 158 pulls the ring 148 away from the clamp 146, an event that permits the housing 105 to come free from the lower housing 108.

Figure 11:
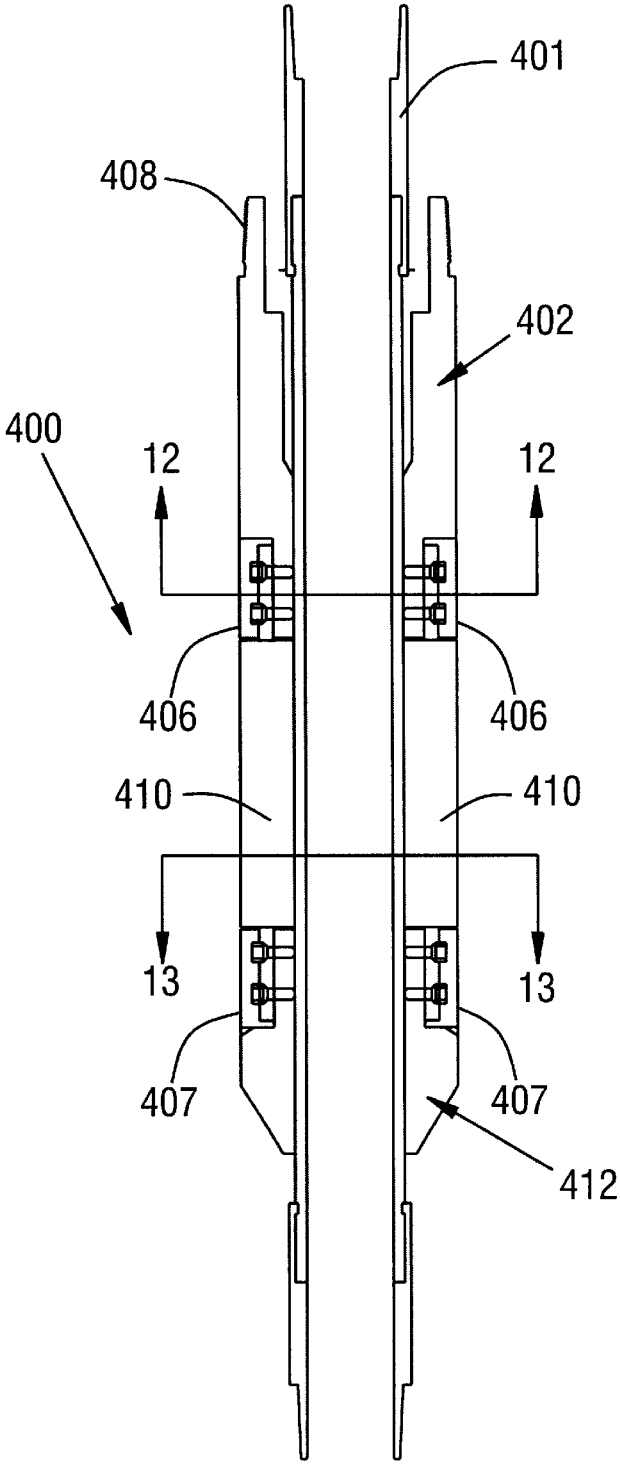
FIG. 11 is a cross-sectional view of a recorder housing according to an embodiment of the invention.
Figure 13:
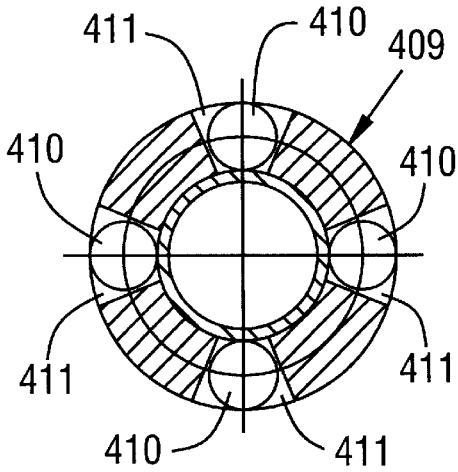

Referring to FIG. 11, in some embodiments, a recorder housing assembly 400 may be secured to and located downhole of the seal bore 160. The recorder housing assembly 400 houses downwardly extending instrument probes 410 that may be used to measure, for example, the pressure below the seal that is provided by the resilient element 84. The assembly 400 may include hollow upper 402, middle 409 (see FIG. 13) and lower 412 housings that permit a tubing 401 to freely pass through. The tubing 401, in turn, may be secured to the tubing 102.

Figure 12:
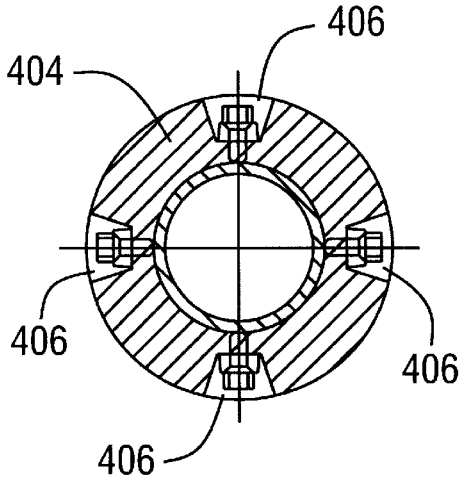
FIGS. 12 and 13 are cross-sectional views of the recorder housing taken along lines 12—12 and 13—13, respectively, of FIG. 11.

The upper housing 402 provides a threaded connection 408 for securing the assembly 400 to the seal bore 160 and includes recesses 406 (see also FIG. 12) for receiving the upper ends of the instrument probes 410. The recesses 406 provide places for mounting the upper ends of the instrument probes to the upper housing 402. The middle housing 409 includes channels 411 that are parallel to the axis of the tubing 401 and receive the instrument probes 410. The lower housing 412 includes recesses 407 for receiving the lower ends of the instrument probes 410 and for mounting the lower ends to the lower housing 412.

Figure 14:
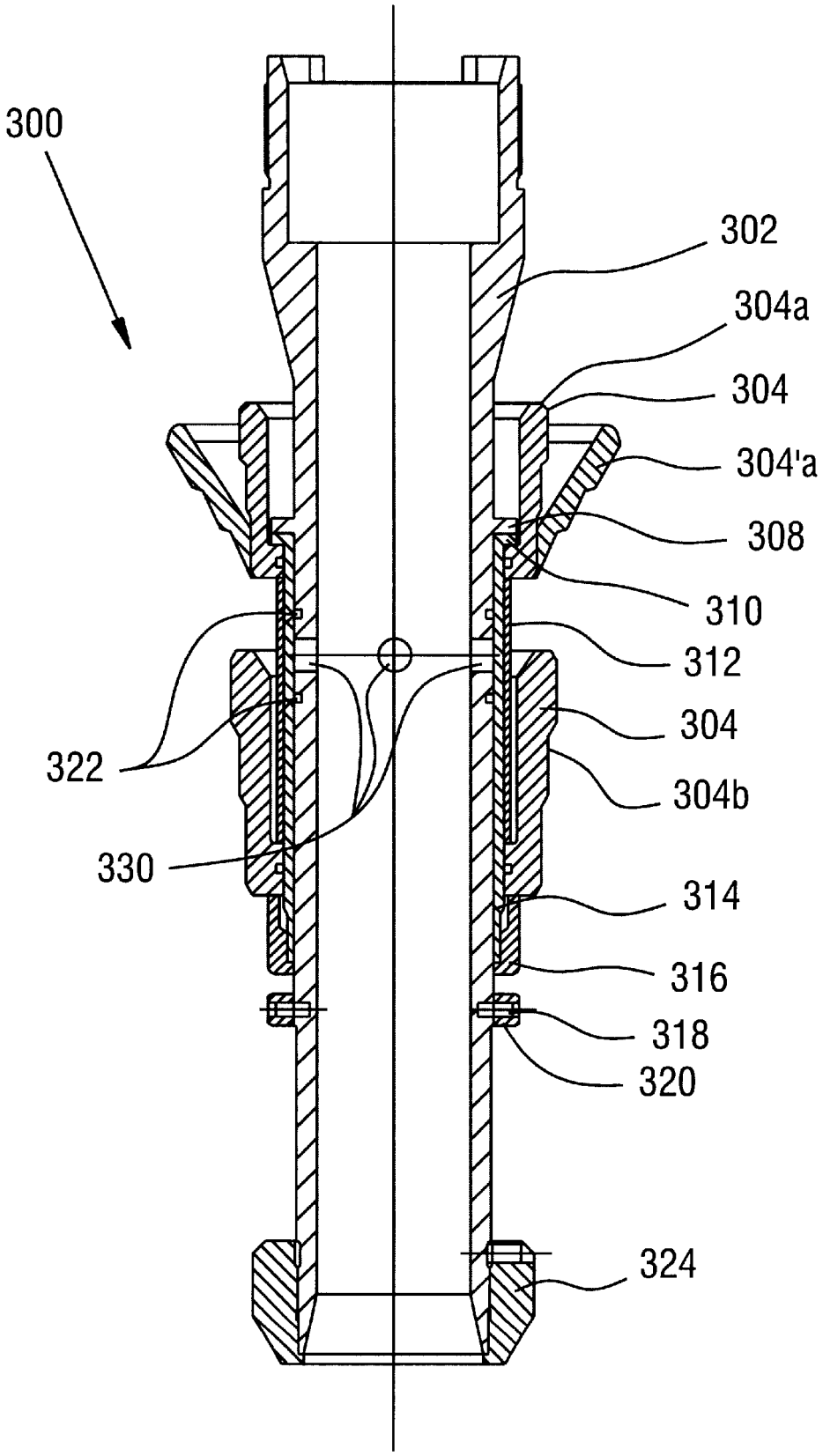
FIG. 14 is a cross-sectional view of a swab cup assembly according to an embodiment of the invention.

The packer 80 may be used to seal off an annulus in a well that has already been perforated. Referring to FIG. 14, to ensure that the required pressure is established in the annulus to rupture the rupture disc 124, a swab cup assembly 300 may be coupled in the test string 82 below the packer 80. In this manner, in some embodiments, the swab cup assembly 300 includes annular swab resilient cups 304 (an upper swab cup 304*a* and a lower swab cup 304*b*, as examples) that circumscribe a mandrel 302 that shares a central passageway with and is located below the seal bore 160. For purposes of causing the swab cups 304 to radially expand, fluid is circulated down the annulus and up through the central passageway of the packer 80 (and string 82). In this manner, this fluid flow causes the swab cups 304 to radially expand (as indicated by the reference numeral 304*a*' for the lower swab cup 304*a*) to seal off the annulus above the swab cups 304 from the perforated well casing below and allow the pressure above the swab cups 304 to rupture the rupture disc 124.

A standoff sleeve 312 that circumscribes the mandrel 302 keeps the upper 304*a* and lower 304*b* swab cups separated. Shear pins 320 radially extend from the mandrel 302 beneath the swab cubs 304 to place a limit on the downward movement by the swab cups 304 and ensure that the sleeve 312 covers radial ports 330 (of the mandrel 302) that may otherwise establish communication between the annulus and the central passageway of the mandrel 302. A sealing sleeve 310 may be located between the sleeve 312 and the mandrel 302.

When the packer 80 is to be retrieved uphole, it may be undesirable for the swab cups 304 to "swab" the well casing. To prevent this from occurring, the pressure in the annulus may be increased to predetermined level to cause the swap cups 304 to shear the shear pins 320. To accomplish this, a metal sleeve 316 may circumscribe the mandrel 302 and may be located below the lower swab cup 304*b*. In this manner, when the pressure in the annulus exceeds the predetermined level, the swab cups 304 cause the sleeve 316 to exert a sufficient force to shear the shear pins 320. Once this occurs, the swab cubs 304 and the sleeves 312 and 310 travel down the mandrel 302 and open the ports 330, a state of the assembly 300 that permits the fluid in the annulus to bypass the swab cups 304.

An alternative way to shear the shear pins 320 is to move the string 82 in an upward direction. In this manner, the swap cups 304 grip the inside of the casing to cause the sleeve 316 to shear the shear pins 310 due to the upward travel of the string 82.

Among the other features of the swab cup assembly 300, an annular extension 308 of the mandrel 302 may limit upward travel of the swab cups 304. A bottom annular extension 324 of the assembly may limit the downward travel of the swap cups 304 after the shear pins 320 shear.

While the invention has been disclosed with respect to a limited number of embodiments, those skilled in the art, having the benefit of this disclosure, will appreciate numerous modifications and variations therefrom. It is intended that the appended claims cover all such modifications and variations as fall within the true spirit and scope of the invention.

What is claimed is:

1. A packer for use inside a well, comprising:

a resilient element adapted to shift from a first position in response to a hydraulic pressure communicated from a surface of the well, wherein the resilient element has an outer diameter that is smaller than the diameter of the well, to a second position, wherein the resilient element seals the annulus in the well, and back to the first position;

a tubing that moves relative to the resilient element when the resilient element is in the second position; and the resilient element circumscribing the tubing.

2. The packer of claim 1, further comprising:

a housing that circumscribes the tubing and includes a seal bore; and seals adapted to form a seal between an interior surface of the seal bore and an exterior surface of the tubing.

3. The packer of claim 2, wherein the seal between the interior surface of the seal bore and the exterior surface of the tubing is formed when the resilient element is in both the first position and the second position.

4. A packer for use inside a well, comprising:

a resilient element adapted to shift between a first position in response to a hydraulic pressure communicated from a surface of the well, wherein the resilient element has an outer diameter that is smaller than the diameter of the well, and a second position, wherein the resilient element seals the annulus in the well;

a tubing that moves relative to the resilient element when the resilient element is in the second position;

the resilient element circumscribing the tubing; and the resilient element and the tubing being concurrently retrievable to the surface after operation.

5. The packer of claim 4, further comprising:

a housing that circumscribes the tubing and includes a seal bore; and seals adapted to form a seal between an interior surface of the seal bore and an exterior surface of the tubing.

6. A method for operating a packer inside a well, the packer including a resilient element and a tubing, the method comprising:

expanding the resilient element in direct response to a hydraulic pressure communicated from a surface of the well to seal the annulus of the well;

providing a tubing that moves relative to the resilient element when the resilient element is in the sealing position; and concurrently retrieving the resilient element and the tubing to the surface after operation.

7. A packer for use inside a well, comprising:

a resilient element adapted to shift between a first position in response to a hydraulic pressure communicated from a surface of the well, wherein the resilient element has an outer diameter that is smaller than the diameter of the well, and a second position, wherein the resilient element seals the annulus in the well;

a tubing that is stationary with respect to the resilient element when the resilient element is in the first position that moves relative to the resilient element when the resilient element is in the second position; and the resilient element circumscribing the tubing.

8. The packer of claim 7, further comprising:

a housing that circumscribes the tubing; and a fastener maintaining the tubing stationary with respect to the resilient element when the resilient element is in the first position and enabling the tubing to move relative to the resilient element when the resilient element is in the second position.

9. The packer of claim 7, further comprising:

a housing that circumscribes the tubing and includes a seal bore; and seals adapted to form a seal between an interior surface of the seal bore and an exterior surface of the tubing when the resilient element is in both the first and second positions.

10. A method for operating a packer inside a well, the packer including a resilient element and a tubing, the resilient element circumscribing the tubing, the method comprising:

deploying the packer in a first position, wherein in the first position, the resilient element has an outer diameter that is smaller than the diameter of the well and the tubing is stationary with respect to the resilient element; and shifting the packer to a second position to expand the resilient element in direct response to hydraulic pressure communicated from a surface of the well, wherein in the second position the resilient element seals the annulus in the well and the tubing moves relative to the resilient element.

11. A completion assembly for use inside a well, comprising:

a packer and a perforating gun;

the packer including a resilient element and a tubing, the resilient element circumscribing the tubing;

the resilient element adapted to expand between a first position, wherein the resilient element has an outer diameter that is smaller than the diameter of the well, and a second position, wherein the resilient element seals the annulus in the well;

the tubing adapted to remain stationary with respect to the resilient element when the resilient element is in the first position;

the tubing adapted to the relative to the resilient element when the resilient element is in the second position; and the perforating gun located below the resilient element and having a cross-sectional diameter that is larger than the cross-sectional diameter of the tubing.

12. The assembly of claim 11, further comprising:

a housing that circumscribes the tubing and includes a seal bore; and seals adapted to form a seal between an interior surface of the seal bore and an exterior surface of the tubing.

13. A completion assembly for use inside a well, comprising:

a retrievable, hydraulically-set packer including a resilient element and a tubing, the resilient element circumscribing the tubing;

wherein in direct response to a hydraulic pressure communicated from a surface of the well, the resilient element is adapted to expand between a first position, wherein the resilient element has an outer diameter that is smaller than the diameter of the well, and a second position, wherein the resilient element seals the annulus in the well; and wherein the tubing is adapted to move relative to the resilient element when the resilient element is in the second position and remain stationary relative to the resilient element when the resilient element is in the first position.

14. The assembly of claim 13, further comprising:

a housing that circumscribes the tubing and includes a seal bore; and seals adapted to form a seal between an interior surface of the seal bore and an exterior surface of the tubing.

15. A method for operating a retrievable packer inside a well, the retrievable packer including a resilient element and a tubing, the resilient element circumscribing the tubing, the method comprising:

deploying the retrievable packer in a first position, wherein the resilient element has an outer diameter that is smaller than the diameter of the well and the tubing remains stationary with respect to the resilient element when the packer is in the first position; and in direct response to hydraulic pressure communicated from a surface of the well, expanding the resilient element to shift the retrievable packer to a second position, wherein the resilient element seals the annulus in the well and the tubing moves relative to the resilient element.

16. A method comprising:

deploying an assembly comprising a packer and a tool downhole in a wellbore;

setting the packer;

after setting the packer, positioning the tool by moving the tool relative to the packer;

operating the tool after the tool is positioned; and after the operation of the tool, releasing the packer from being set.

17. The method of claim 16, wherein the packer remains set while the tool is being positioned.

18. The method of claim 16, wherein the releasing comprises:

initiating an action to release the packer from being set after the operation of the tool.

19. The method of claim 16, further comprising:

in response to the releasing, retrieving the assembly from downhole.

20. The method of claim 16, wherein the positioning does not affect a state of the packer.

21. The method of claim 16, further comprising:

not initiating any action to change a state of the packer until completion of the operation of the tool.

22. The method of claim 16, wherein the tool comprises a perforating gun, and the operating comprises firing the perforating gun.

23. The method of claim 22, wherein the positioning comprises:

positioning the perforating gun to a location of the wellbore to be perforated.

24. An apparatus comprising:

a packer adapted to ho sot and released downhole in a wellbore; and a cool connected to the packer and adapted to:

remain stationary relative to the packer before the packer is set;

move relative to the packer after the packer is set to position the tool; and operate after the tool is positioned.

25. The apparatus of claim 24, wherein the packer remains set while the tool is being positioned.

26. The apparatus of claim 24, wherein the packer is adapted to respond to an action initiated to release the packer from being set after the operation of the tool.

27. The apparatus of claim 24, wherein the packer is adapted to not respond to the movement of the tool during the positioning of the tool.

28. The apparatus of claim 24, wherein the tool comprises a perforating gun, and the operation of the perforating gun comprises firing the perforating gun.

29. The apparatus of claim 28, wherein the perforating gun is adapted to move to position the perforating gun to a location of the wellbore to be perforated.

* * * * *

UNITED STATES PATENT AND TRADEMARK OFFICE

CERTIFICATE OF CORRECTION

PATENT NO. : 6,564,876 B2 
DATED : May 20, 2003
INVENTOR(S) : Vladimir Vaynshteyn and James D. Hendrickson et al.

It is certified that error appears in the above-identified patent and that said Letters Patent is hereby corrected as shown below:

Title page,
Item [75], Inventors, correct spelling of inventors name to -- Raghu Madhavan --

Signed and Sealed this

Twenty-fifth Day of January, 2005

JON W. DUDAS
*Director of the United States Patent and Trademark Office*